US012102250B2

(12) United States Patent
Clark

(10) Patent No.: US 12,102,250 B2
(45) Date of Patent: Oct. 1, 2024

(54) PLANT POT HANGER

(71) Applicant: IWPH Company, Hannon (CA)

(72) Inventor: Richard D. Clark, Hannon (CA)

(73) Assignee: IWPI Company, Hannon (CA)

( * ) Notice: Subject to any disclaimer, the term of this patent is extended or adjusted under 35 U.S.C. 154(b) by 213 days.

(21) Appl. No.: 17/368,606

(22) Filed: Jul. 6, 2021

(65) Prior Publication Data

US 2022/0000288 A1 Jan. 6, 2022

Related U.S. Application Data

(60) Provisional application No. 63/048,572, filed on Jul. 6, 2020.

(51) Int. Cl.
*A47G 7/04* (2006.01)

(52) U.S. Cl.
CPC ..... *A47G 7/045* (2013.01)

(58) Field of Classification Search
USPC ..... 47/67, 65.5, 66.7, 41.11
See application file for complete search history.

(56) References Cited

U.S. PATENT DOCUMENTS

| | | | | |
|---|---|---|---|---|
| 1,600,931 A | | 9/1926 | Chatham | |
| 4,181,234 A | * | 1/1980 | Feighan | A47G 7/047 248/318 |
| 4,244,301 A | * | 1/1981 | Nakatsu | A47B 43/006 211/113 |
| 4,319,428 A | * | 3/1982 | Fox | A01G 17/04 47/42 |
| 4,669,693 A | | 6/1987 | Kagan | |
| 4,956,937 A | * | 9/1990 | Haddox | A47G 7/047 248/323 |
| 6,062,520 A | | 5/2000 | Ralston et al. | |
| D580,257 S | * | 11/2008 | Squyres | D8/349 |
| 7,726,072 B1 | | 6/2010 | Kuslaka et al. | |
| D784,849 S | | 4/2017 | Liu | |
| D895,340 S | * | 9/2020 | Sabbagh | D6/718.1 |
| 2006/0277824 A1 | * | 12/2006 | Clair | A47G 7/047 248/318 |
| 2019/0110416 A1 | | 4/2019 | Crain | |

FOREIGN PATENT DOCUMENTS

| | | | | |
|---|---|---|---|---|
| GB | 2244089 | * | 11/1991 | A01G 17/12 |
| JP | 11-196989 | * | 7/1999 | A47G 7/04 |
| JP | 1999196989 A | | 7/1999 | |

OTHER PUBLICATIONS

U.S. Pat. No. 770,738 A; issued Sep. 27, 1904 to H.C. Chessman (unable to enter shorter number into Patent Number field above).

* cited by examiner

*Primary Examiner* — Andrea M Valenti
(74) *Attorney, Agent, or Firm* — Jack D. Stone, Jr.; Scheef & Stone, L.L.P.

(57) ABSTRACT

A plant pot hanger has three or more cables, each of which cables have a first end and a second end, and wherein the three or more cables are secured together at the first ends of the respective cables. A sliding loop is formed at the second end of each respective cable. Each cable is threaded through the sliding loop of a respective adjacent cable to form a ring adaptable for running under a rim of a plant pot and supporting the plant pot. A loop or a hook for hanging the plant pot preferably extends from the respective first ends of the three or more cables.

7 Claims, 6 Drawing Sheets

PLANT POT HANGER

CROSS-REFERENCE TO RELATED APPLICATIONS

This application claims the benefit of U.S. Provisional Application No. 63/048,572, filed Jul. 6, 2020, which application is hereby incorporated herein by reference, in its entirety.

TECHNICAL FIELD

The invention relates generally to a plant pot hanger.

BACKGROUND

Conventionally, plant pots are held in non-descript pot hangers that operate in different manners and different configurations. A problem with such pot hangers is that they may not be durable or serviceable, may require different sizes and configurations of pot hangers, and may be bulky and aesthetically unpleasing.

Therefore, what is needed is an apparatus and method for providing an efficient but pleasant-looking support that is well-placed and adjustable, as well as durable, malleable and compact.

A solution would be an apparatus and method that is durable, serviceable, malleable, aesthetically pleasing, compact, accommodating of different sizes of pots, and without causing undesirable visual effects or otherwise detracting from the overall decorative effect desired.

SUMMARY

The present invention, accordingly, provides a plant pot hanger having three or more cables, each of which cables have a first end and a second end, and wherein the three or more cables are secured together at the first ends of the respective cables. A sliding loop is formed at the second end of each respective cable. Each cable is threaded through the sliding loop of a respective adjacent cable to form a ring adaptable for running under a rim of a plant pot and supporting the plant pot. A loop or a hook for hanging the plant pot preferably extends from the respective first ends of the three or more cables.

In a plant pot hanger having a first cable and a second cable, the second cable is configured to form a top loop and a third cable. The first, second, and third cables and top loop are secured by a ferrule, wherein the top loop extends through the top end of the ferrule, and the first, second, and third cables extend through the bottom end of the ferrule. A sliding loop is secured at an end of each respective cable, and wherein the first cable is threaded through the sliding loop of the third cable, the second cable is threaded through the sliding loop of the first cable, and the third cable is threaded through the sliding loop of the second cable, to form a tri-sector ring adaptable for running under a rim of a plant pot and supporting the plant pot. Cable locks are preferably used for securing the respective sliding loop at an end of each respective cable.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
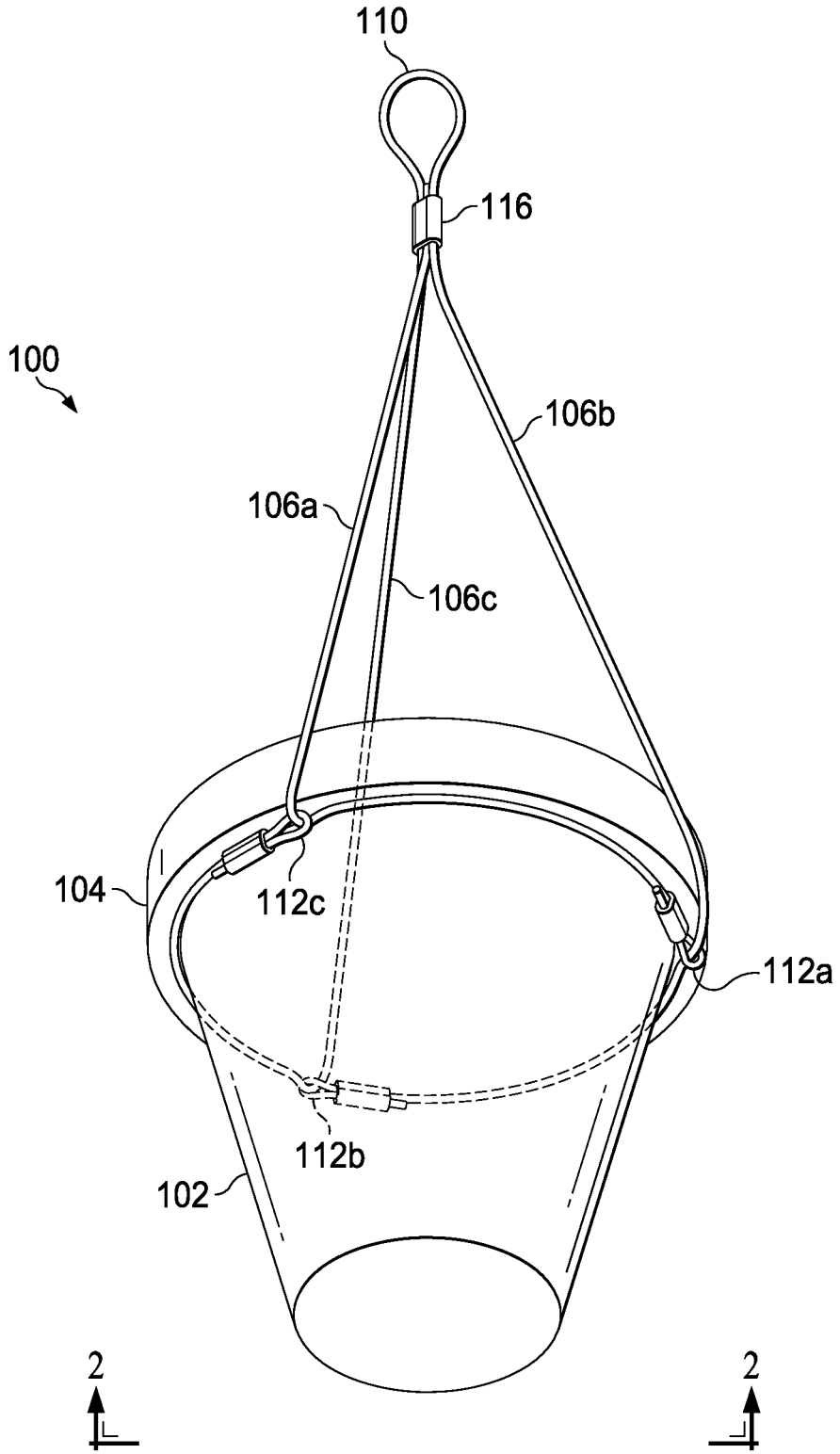
FIG. 1 is a perspective view of a plant pot hanger according to one preferred embodiment of the present invention.

Refer now to the drawings wherein like or similar elements are designated by the same reference numeral through the several views. The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Referring to FIG. 1 of the drawings, the reference numeral 100 generally designates a plant pot hanger assembly comprising a plant pot 102 suspended by cables 106*a*, 106*b* and 106*c* (collectively referred to herein as cables 106) which run under a rim 104 formed in the upper circumference of plant pot 102 in accordance with one embodiment of the invention. Plant pot 102 is a conventional plant pot made in any conventional manner using conventional materials, such as clay, plastic, ceramic, or the like. Plant pots are considered to be well-known in the art, and so will not be described in further detail herein, except insofar as necessary to describe the invention.

Figure 4:
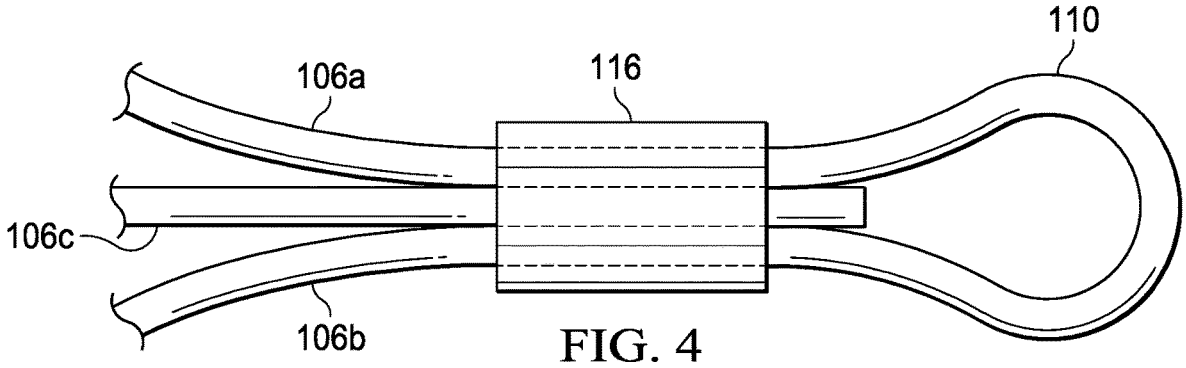
FIG. 4 exemplifies a ferrule used to form a hanging loop for hanging the plant pot hanger of FIG. 1, and for attaching it to a hook.

Cables 106 are preferably fabricated from 3/64" diameter braided SAE 304 stainless steel aircraft cable, but may be of any suitable diameter fabricated from any suitable material, preferably corrosion resistant material, including, by way of example but not limitation, wires, carbon fiber, nylon, plastic, or the like. As shown most clearly in FIGS. 1 and 4, cables 106 are preferably secured together at an upper end with a ferrule 116, though other means may be used, such as tack welding, epoxy, and the like. Two cables 106*a* and 106*b* preferably constitute a single cable which is preferably configured to form a hanging loop 110 or hook for suspending plant pot 102 from a further hook or other mounting support (not shown). Ferrule 116 is preferably made from aluminum, but may be made from any suitable material.

Figure 2:
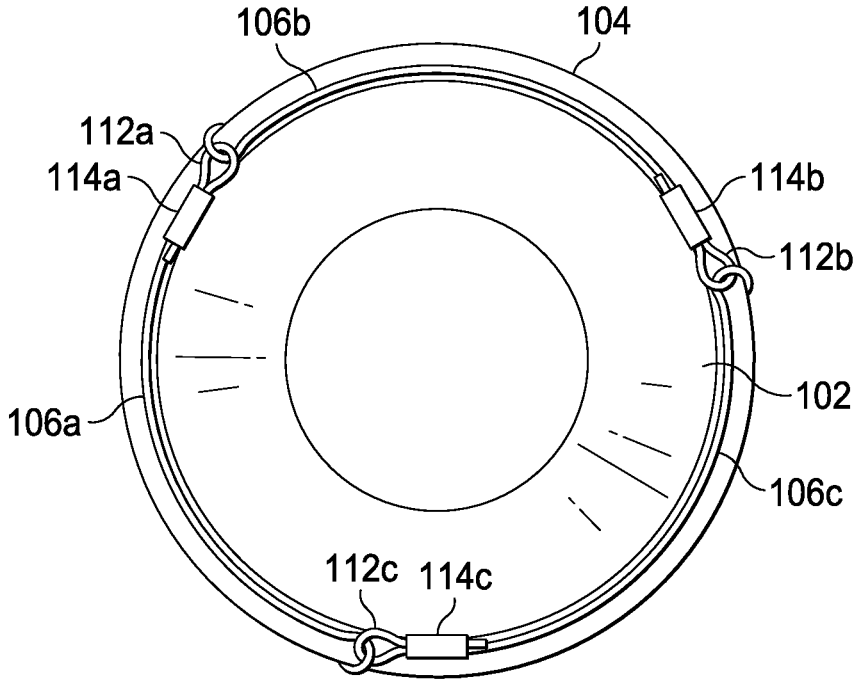
FIG. 2 is a bottom view of the plant pot hanger of FIG. 1, as viewed pursuant to line 2-2 of FIG. 1.
Figure 3:
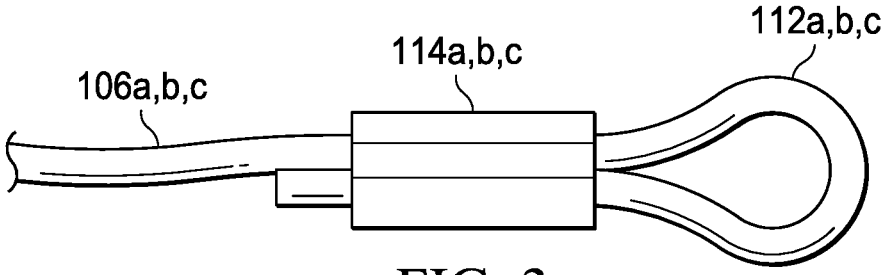
FIG. 3 exemplifies a sliding loop of the plant pot hanger of FIG. 1.

As shown most clearly in FIGS. 1-3, at a lower end of each of cables 106*a*, 106*b* and 106*c*, a respective sliding loop 112*a*, 112*b* and 112*c* is formed and secured thereto with a respective cable lock 114*a*, 114*b* and 114*c*. Alternatively, the sliding loops may be secured to respective ends using ferrules, tack welding, epoxy, or the like.

FIGS. 1 and 2 show how cables 106*a*, 106*b* and 106*c*, and respective sliding loops 112*a*, 112*b* and 112*c*, are interconnected to form a ring under rim 104 for supporting plant pot 102. More specifically, cable 106*a* extends downwardly from ferrule 116 to rim 104, through sliding loop 112*c*, and then about one third of the circumference (~120°) under rim 104. Similarly, cable 106*b* extends downwardly from ferrule 116 to rim 104, through sliding loop 112*a*, and then about a further one third of the circumference (~120°) of the pot under rim 104. Finally, cable 106*c* extends downwardly from ferrule 116 to rim 104, through sliding loop 112*b*, and then about a further one third of the circumference (~120°) of the pot under rim 104. As best viewed in FIG. 1, it can be appreciated that cables 106 form a tri-sector ring under rim 104 that automatically adjusts to the diameter of the rim as pot plant 102 is suspended from the cables.

In a preferred method of use, cables 106 are laid out on a flat surface, such as the ground or a table, so that some semblance of a triangle is formed. A plant pot 102 is placed in the triangle. The cables are then pulled upwardly while being tightened under rim 104. Hanging loop 110 is then placed over a hook (not shown) to thereby support plant pot 102.

Figure 5:
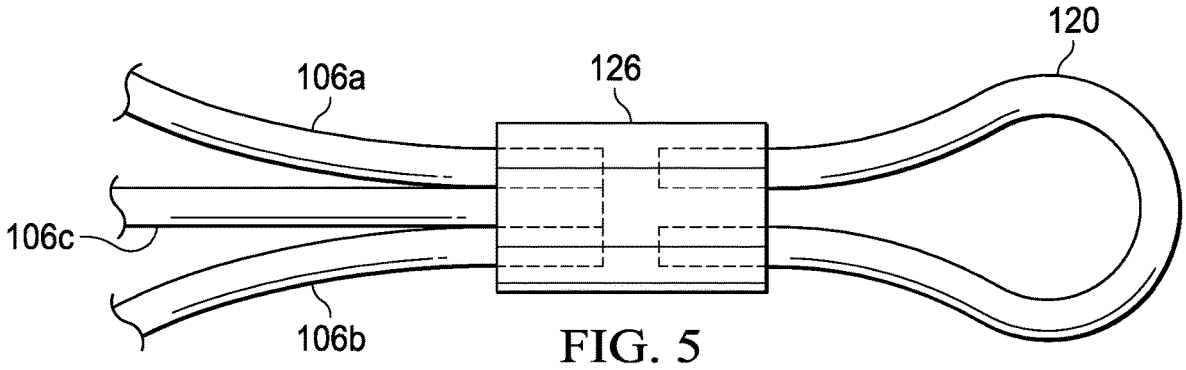
FIG. 5 exemplifies an alternate embodiment of a ferrule used to form a hanging loop for hanging the plant pot hanger of FIG. 1, and for attaching it to a hook.

FIG. 5 depicts an alternate preferred embodiment of the present invention whereby cable portions 106*a* and 106*b* are separate cables rather than a single longer cable. Each of cables 106 have ends that securely terminate in one end of a ferrule 126. A loop 120 or other suitable means (e.g., a hook) is secured to the other end of ferrule 126 for suspending the plant pot holder. Operation of the plant pot hanger of FIG. 5 is substantially similar to operation of the plant pot hanger of FIGS. 1-4.

Figure 6:
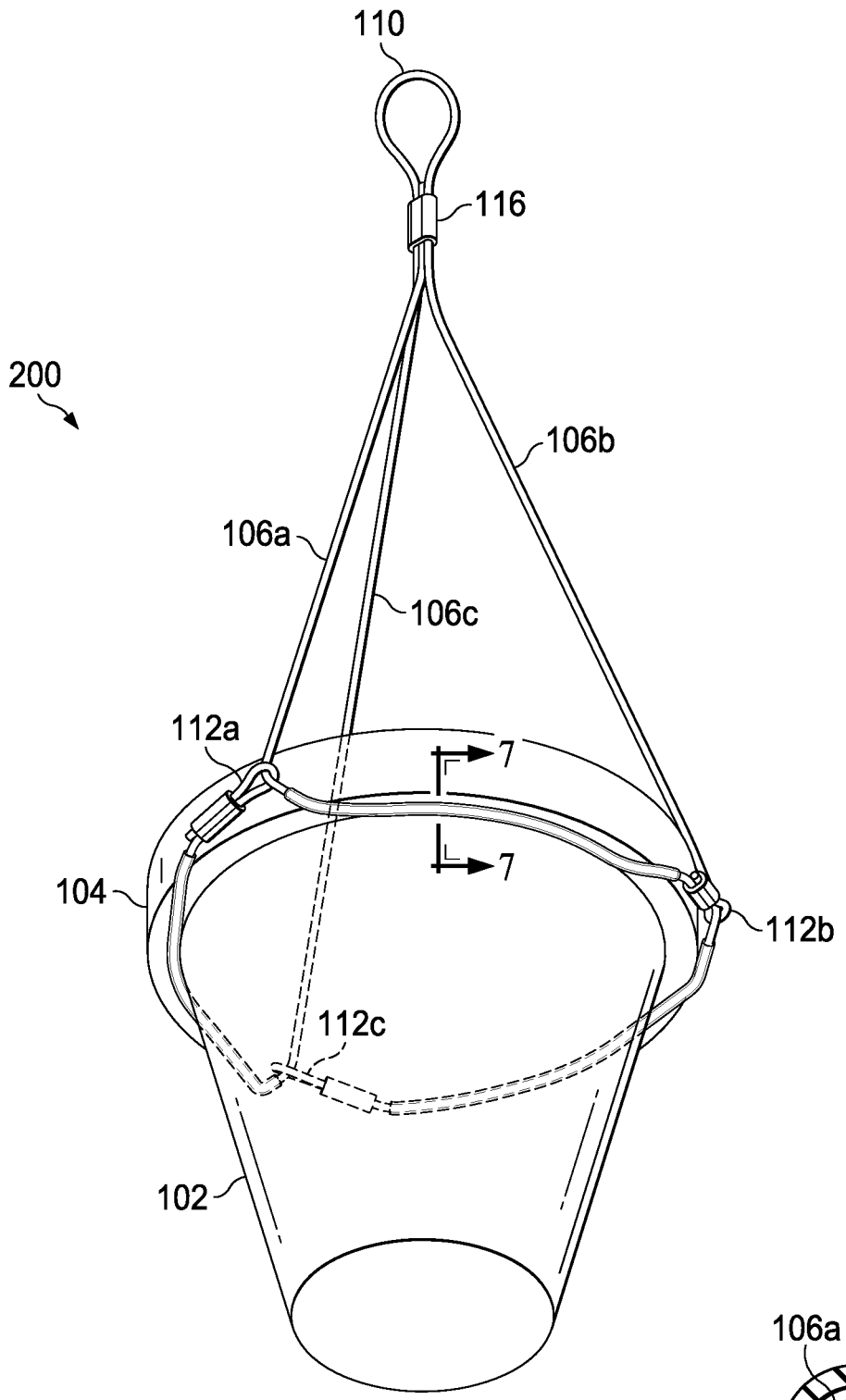
FIG. 6 exemplifies the embodiments of FIGS. 1-5 further comprising tubing through which portions of cables that engage a plant pot are run.
Figure 7:
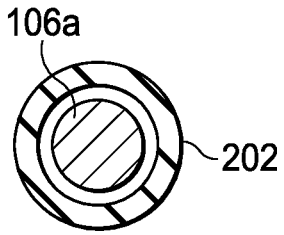
FIG. 7 depicts a cross-section of cable running through tubing in accordance with principles of the invention, the cross-section being taken along line 7-7 of FIGS. 6 and 10.

FIGS. 6 and 7 depict an alternate embodiment of a plant pot hanger assembly 200 similar to plant pot hanger assembly 100 of FIGS. 1-5. In addition to the elements and features of the assembly 100, assembly 200 further includes tubing 202 through which portions of cables 106 that engage and support plant pot 102 under rim 104 are run. Tubing 202 is preferably made from silicon, though it may be made from any suitable material (e.g., a polymer). Tubing 202 is further preferably cut to a desirable length, such as three to six inches. By incorporating tubing 202 into assembly 200, cables 106 can support plant pot 102 more securely with a better grip. Further, when preparing to use the cables 106 to support plant pot 102, cables 106 with tubing 202 make a better triangle in which to place plant pot 102 prior to pulling the cables upwardly while tightening the cables around plant pot 102 and under rim 104.

Figure 8:
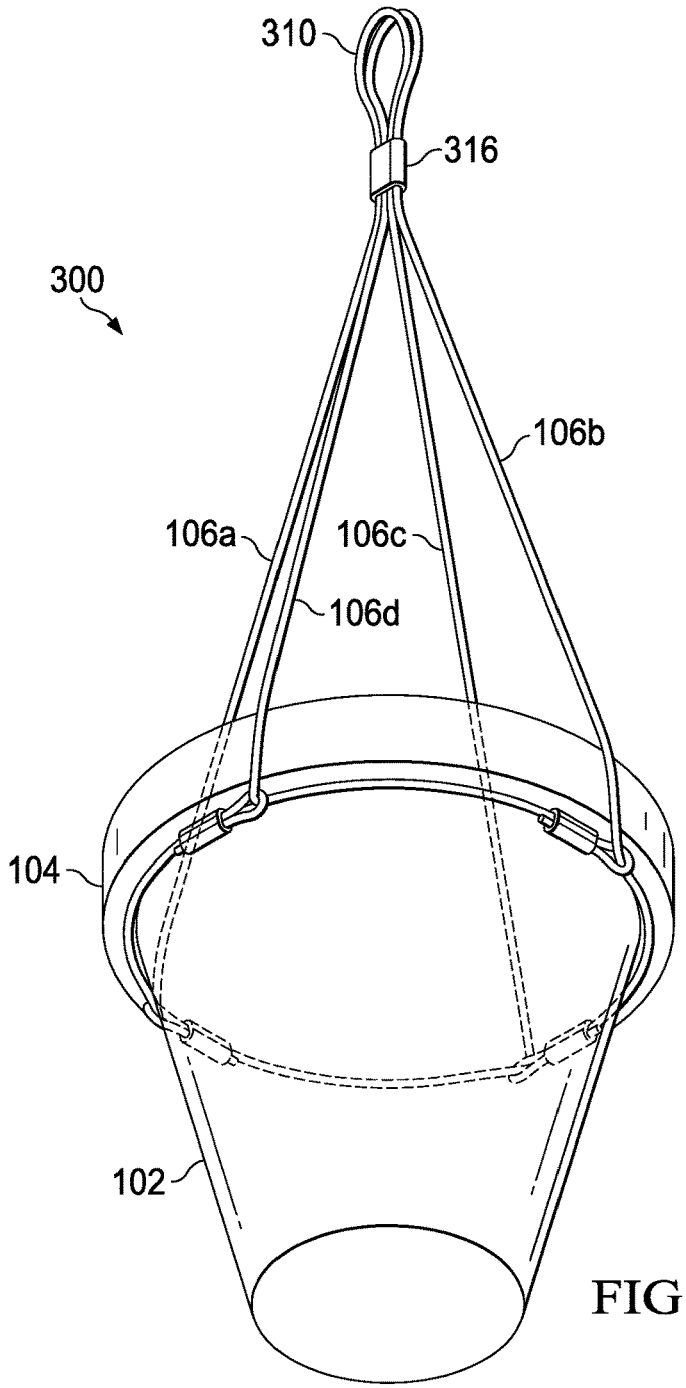
FIG. 8 exemplifies an alternate embodiment of a plant pot hanger assembly utilizing four cables in accordance with principles of the invention.
Figure 9:
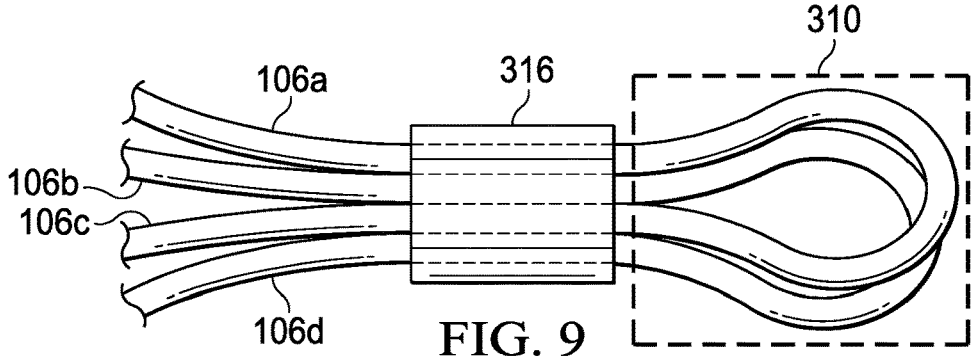
FIG. 9 exemplifies a ferrule used to form a hanging loop for hanging the plant pot hanger of FIG. 8, and for attaching it to a hook.

FIGS. 8 and 9 exemplify an alternate embodiment 300 of the plant pot hanger of FIGS. 1-5 wherein a fourth cable 106*d* is modeled in addition to cables 106*a*, 106*b*, and 106*c*. Cables 106*a* and 106*c* are preferably paired to constitute two halves of a first cable (not shown as such) folded above a ferrule 316 or the like to form a first half of a hanging loop 310. Similarly, cables 106*b* and 106*d* are preferably paired to constitute two halves of a second cable (not shown as such) folded above the ferrule 316 to form a second half of the hanging loop 310. Alternately, cables 106*a* and 106*b* could be paired and cables 106*c* and 106*c* could be paired.

At each end of each of cables 106*a*, 106*b*, 106*c*, and 106*d*, a respective sliding loop 112*a*, 112*b*, 112*c*, and 112*d* is formed and secured thereto with a respective cable lock 114*a*, 114*b*,114*c*, and 114*d*. Alternatively, the sliding loops may be secured to respective ends using ferrules, tack welding, epoxy, or the like.

Cables 106*a*, 106*b*, 106*c*, and 106*d* and respective sliding loops 112*a*, 112*b*, 112*c*, and 112*d* are interconnected to form a ring under rim 104 for supporting plant pot 102, similarly as described above with respect to FIGS. 1 and 2. Generally, each cable 106 is threaded through the sliding loop 112 of a respective adjacent cable to form a ring adaptable for running under rim 104 of plant pot 102 and supporting the plant pot.

In a preferred method of use, cables 106 are laid out on a flat surface, such as the ground or a table so that some semblance of a square is formed. A plant pot 102 is placed in the square. The cables are then pulled upwardly while being tightened under rim 104. Hanging loop 310 is then placed over a hook (not shown) to thereby support plant pot 102.

Figure 10:
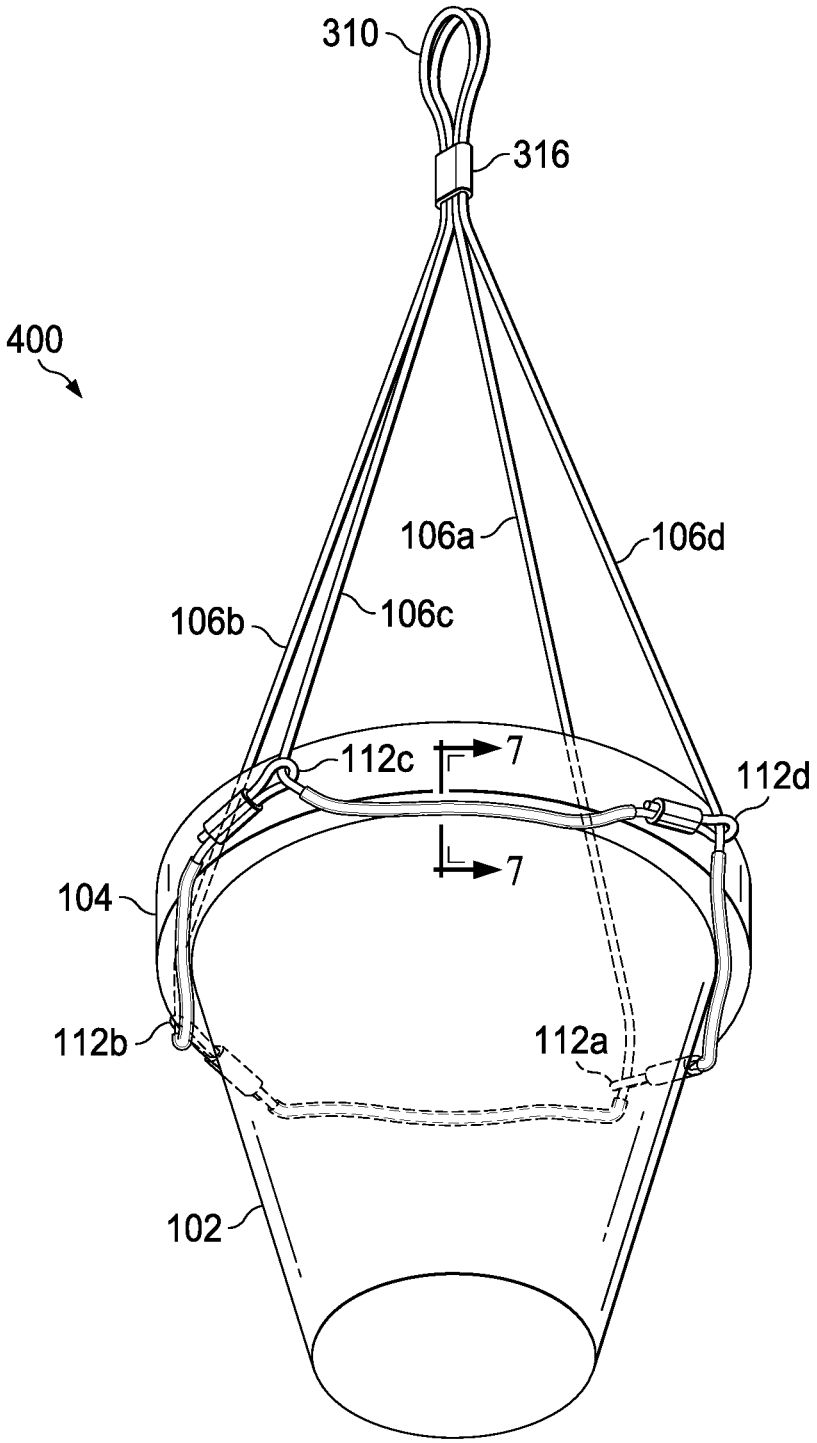
FIG. 10 exemplifies the embodiments of FIGS. 8 and 9 further comprising tubing through which portions of cables that engage a plant pot are run.

FIG. 10 depicts an alternate embodiment of a plant pot hanger assembly 400 similar to plant pot hanger assembly 300 of FIGS. 8 and 9. As similarly discussed above with respect to FIGS. 6 and 7, in addition to the elements and features of the assembly 300, assembly 400 further includes tubing 202 through which portions of cables 106 that engage and support plant pot 102 under rim 104 are run. By incorporating tubing 202 into assembly 400, cables 106 can support plant pot 102 more securely with a better grip. Further, when preparing to use the cables 106 to support plant pot 102, cables 106 with tubing 202 make a better square in which to place plant pot 102 prior to pulling the cables upwardly while tightening the cables around plant pot 102 and under rim 104.

The use of the present invention provides a number of advantages over the prior art. For example, it is durable, serviceable, malleable, aesthetically pleasing, compact, accommodating of different sizes of pots, and without causing undesirable visual effects or otherwise detracting from the overall decorative effect desired.

It is understood that the present invention may take many forms and embodiments. Accordingly, several variations may be made in the foregoing without departing from the spirit or the scope of the invention. For example, more than three cables may be used in accordance with principles of the present invention.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A plant pot hanger comprising:

a first cable having a first end and a second end and defining a middle portion, a first portion interposed between the first end and the middle portion, and a second portion interposed between the second end and the middle portion;

a second cable having a first end and a second end;

a ferrule securing the first portion and second portion of the first cable together with the first end of the second cable such that the middle portion of the first cable forms a top loop extending from one end of the ferrule, and such that the first and second ends of the first cable and the second end of the second cable extend from an opposing end of the ferrule;

wherein the first and second ends of the first cable and the second end of the second cable form a sliding loop secured with a respective cable lock; and wherein the first end of the first cable is threaded through the sliding loop of the second end of the second cable, the second end of the first cable is threaded through the sliding loop of the first end of the first cable, and the second end of the second cable is threaded through the sliding loop of the second end of the first cable, to form a tri-sector ring adaptable for running under a rim of a plant pot and supporting the plant pot.

2. The plant pot hanger of claim 1, further comprising:

a first tubing through which the first cable extends; and a second tubing through which the second cable extends.

3. The plant pot hanger of claim 1, further comprising:

a first tubing through which the first portion of the first cable extends;

a second tubing through which the second portion of the first cable extends; and a third tubing through which the second cable extends.

4. The plant pot hanger of claim 1, further comprising:

a first silicon tubing through which the first portion of the first cable proximate a sliding loop extends;

a second silicon tubing through which the second portion of the first cable proximate a sliding loop extends; and a third silicon tubing through which the second cable proximate a sliding loop extends.

5. The plant pot hanger of claim 1, wherein the cable is made from SAE 304 stainless steel.

6. The plant pot hanger of claim 1 wherein the cable locks for securing the respective sliding loop at an end of each respective cable is at least one of ferrules, tack welds, and epoxy.

7. A plant pot hanger comprising:

a first cable having a first end and a second end and defining a middle portion, a first portion interposed between the first end and the middle portion, and a second portion interposed between the second end and the middle portion;

a second cable having a first end and a second end;

first means for securing the first portion and second portion of the first cable together with the first end of the second cable such that the middle portion of the first cable forms a top loop extending from one end of the first means for securing, and such that the first and second ends of the first cable and the second end of the second cable extend from an opposing end of the first means for securing;

wherein the first and second ends of the first cable and the second end of the second cable each form a respective sliding loop secured with a respective second means for securing; and wherein the first end of the first cable is slidably threaded through the sliding loop of the second end of the second cable, the second end of the first cable is slidably threaded through the sliding loop of the first end of the first cable, and the second end of the second cable is slidably threaded through the sliding loop of the second end of the first cable, to form a tri-sector ring adaptable for running under a rim of a plant pot and supporting the plant pot.

* * * * *